US006672387B2

(12) United States Patent
Brady et al.

(10) Patent No.: US 6,672,387 B2
(45) Date of Patent: Jan. 6, 2004

(54) OIL AND GAS PRODUCTION WITH DOWNHOLE SEPARATION AND REINJECTION OF GAS

(75) Inventors: Jerry L. Brady, Anchorage, AK (US); John M. Klein, Anchorage, AK (US); Steven P. Petullo, San Antonio, TX (US); Curtis G. Blount, Wasilla, AK (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 10/160,643

(22) Filed: Jun. 3, 2002

(65) Prior Publication Data

US 2003/0221827 A1 Dec. 4, 2003

(51) Int. Cl.[7] ..... E21B 43/38; B01D 45/12

(52) U.S. Cl. ..... 166/266; 166/105.5; 166/369; 95/261; 95/270; 96/196; 96/216

(58) Field of Search ..... 166/265, 266, 166/369, 105, 105.5, 105.6, 106, 169, 325; 95/261, 269, 270; 96/177, 195, 196, 216

(56) References Cited

U.S. PATENT DOCUMENTS 5,431,228 A 7/1995 Weingarten et al.
5,482,117 A * 1/1996 Kolpak et al. ..... 166/265
5,794,697 A 8/1998 Wolflick et al.
6,026,901 A 2/2000 Brady et al.
6,035,934 A 3/2000 Stevenson et al.
6,189,614 B1 2/2001 Brady et al.
6,283,204 B1 9/2001 Brady et al.
6,463,730 B1 * 10/2002 Keller et al. ..... 60/39.24
6,564,865 B1 * 5/2003 Brady et al. ..... 166/105.3

OTHER PUBLICATIONS

New Design for Compact–Liquid Gas Partial Separation Down Hole and Surface Installations for Artificial Life Applications, Jean S. Weingarten, et al, SP 30637, presented Oct. 22–25, 1995 at Dallas, Texas.
US patent application No. 10/025,444 filed Dec. 19, 2001.

* cited by examiner

*Primary Examiner*—David Bagnell
*Assistant Examiner*—Jennifer H Gay
(74) *Attorney, Agent, or Firm*—F. Lindsay Scott

(57) ABSTRACT

A system (SPARC) for producing a mixed gas-oil stream wherein gas is to be separated and compressed downhole in a turbine-driven compressor before the gas is injected into a subterranean formation. A turbine bypass valve allows all of the stream to bypass the turbine during start-up until surging in the production stream has subsided. The valve then opens to allow a portion of the stream to pass through the turbine. Also, a compressor recycle valve recycles the compressor output until the surging in the stream has subsided while a check valve prevents back flow into the outlet of the compressor.

19 Claims, 5 Drawing Sheets

FIG. 3
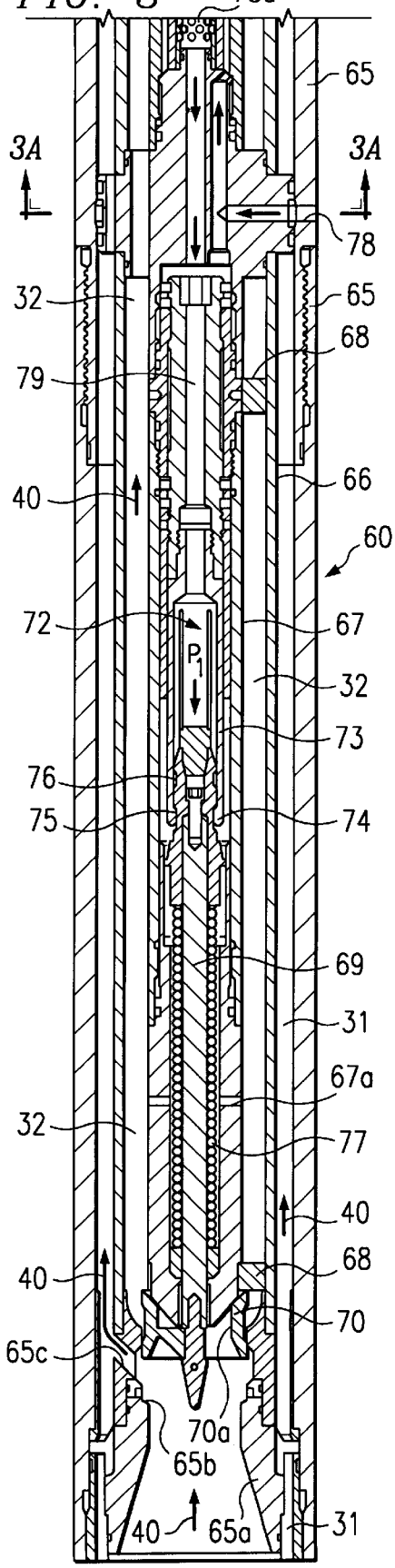
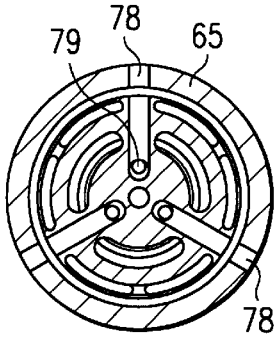
FIG. 3A
FIG. 4
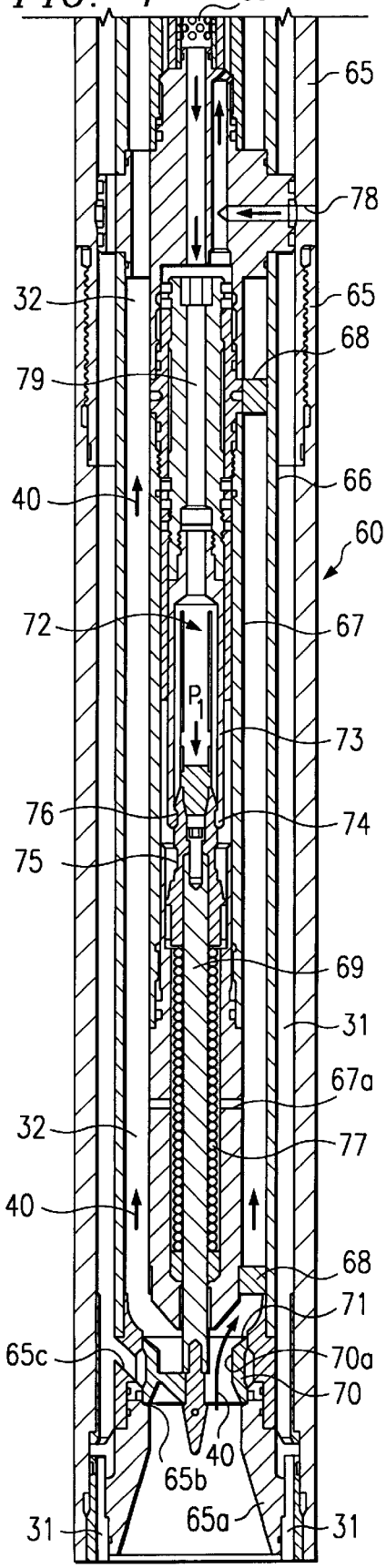

OIL AND GAS PRODUCTION WITH DOWNHOLE SEPARATION AND REINJECTION OF GAS

TECHNICAL FIELD

The present invention relates to downhole separation, compression, and reinjection of a portion of the gas from a production stream produced from a subterranean zone and in one aspect relates to a method and subsurface system (SPARC) for separating gas from a production stream wherein the separated gas is compressed and reinjected by a downhole turbine-compressor unit of a SPARC which includes controls which, in turn, allow the entire production stream to initially bypass the turbine-compressor unit of the SPARC during start-up of production.

BACKGROUND

It is well known that many hydrocarbon reservoirs produce extremely large volumes of gas along with crude oil and other formation fluids, e.g. water. In such production, it is not unusual to experience gas-to-oil ratios (GOR) as high as 25,000 standard cubic feet per barrel (scf/bbl.) or greater. As a result, large volumes of gas must be separated from the liquids before the liquids are moved on to market or storage. Where the production sites are convenient to end users, this gas is a valuable asset when demands for the gas are high. However, when demands are low or when a producing reservoir is located in a remote area, large volumes of produced gas can present major problems if the produced gas can not be timely and properly disposed of Where there is no demand for the produced gas, it is common to "reinject" the gas into a suitable, subterranean formation. For example, the gas may be injected back into the "gas cap" of a production zone to maintain pressure within the reservoir and thereby increase the ultimate liquid recovery therefrom. In other applications, the gas may be injected into a producing formation through an injection well to drive the hydrocarbons towards a production well. Further, the produced gas may be injected and "stored" in an appropriate formation from which it can be recovered later when the situation changes.

To separate and re-inject the gas, large surface facilities are normally required at or near the production site. These facilities are expensive due, in part, to the high-horsepower, gas compressor train(s) needed to handle, compress and inject the large volumes of gas. It follows that significant cost savings can be realized if these compressor-horsepower requirements can be reduced.

Recently, techniques have been proposed for significantly reducing the amounts of gas that need to be handled at the surface. Several of these techniques involve the use of a subsurface processing and reinjection compressor unit (SPARC) which is positioned downhole in the wellbore to separate at least a portion of the gas before the production stream is produced to the surface. A typical SPARC is comprised of an auger separator and a turbine-driven compressor unit. Gas is separated from the production stream as the stream passes through the auger and is fed into the compressor which, in turn, is driven by a turbine; the turbine being driven by the production stream, itself.

The compressed gas can then either be injected directly into a designated formation (e.g. gas cap) adjacent the wellbore or be brought to the surface through a separate flowpath for further handling. For examples of such SPARCs and how each operates, see U.S. Pat. No. 5,794,697, 6,026,901, 6,035,934, and 6,189,614.

Unfortunately, the turbine-compressor unit of a typical SPARC is subject to "surging" during the start-up period of a production well. That is, a typical production stream almost always contains slugs of liquid when the well is first brought on stream, either initially or after a well has been shut-in for some period. These liquid slugs will cause the turbine/compressor to fluctuate and operate at critical shaft speeds for extended periods which, in turn, can cause severe damage to the turbine-compressor and significantly shorten the operational life of the SPARC. Accordingly, it is desirable to bypass the turbine/compressor during the start-up period of a well until the surging in the production stream has subsided and the composition of the production stream has steadied out.

SUMMARY OF THE INVENTION

The present invention provides a subsurface system for producing a mixed gas-oil stream to the surface from a subterranean zone through a wellbore wherein at least a portion of the contained gas is separated from said mixed gas-oil stream downhole and is compressed to produce a compressed gas which is re-injected into a formation adjacent the wellbore. As will be understood in the art, the production stream will likely also include some water and some solids (e.g. sand, debris, etc.) which will be produced with the oil and gas so, as used herein, "mixed gas-oil stream(s)" is intended to include such production streams.

More specifically, the present system for producing a mixed gas-oil stream is comprised of a string of tubing extending from the production zone to the surface which has a turbine-compressor system (SPARC) positioned downhole therein. The SPARC is comprised of an upstream separator section; a turbine-compressor section; a downstream separator section; and a means for preventing surging in the turbine-compressor section during the start-up of the SPARC. Basically, the means for preventing surging is comprised of a turbine bypass valve for bypassing the turbine during start-up and a compressor recycle valve for recycling the output of the compressor until surging in the production stream has subsided.

In operation, a well is put on production by opening a choke valve or the like at the surface. As will be understood in the art, normally there will be "surging" in the production stream during the start-up of the well due to alternating slugs of gas and liquid in the stream. If unchecked, this surging can cause significant damage to the turbine and/or compressor thereby shortening the operational lives thereof.

As in prior art SPARC's of this type, at least a portion of the heavier components, e.g. sand, etc., is separated from the remainder of the production stream as the stream flows through the upstream separator section, e.g. auger separator. These separated components bypass the turbine to thereby prevent erosion within the turbine. However, in the present invention, the turbine bypass valve, when open, allows the separated portion of the stream to be recombined with the remainder of the stream whereby the entire stream bypasses the turbine until surging in the stream has subsided.

As the flowrate of the production stream increases, the change in the differential pressure (i.e. difference between the turbine outlet pressure and the well annulus pressure) acts to close the turbine bypass valve so that only the separated portion of the stream will bypass the turbine. The remainder of the stream, instead of being recombined with the separated portion, will now be directed into the turbine to drive same.

Also, during the start-up period, the open compressor recycle valve will direct the flow from the outlet of the compressor into the downstream separator section which, in turn, separates at least a portion of the gas from the stream and directs this gas into the compressor. The recycle valve remains open until the change in the differential pressure between the outlet pressure of the compressor and the outlet pressure of the turbine causes the compressor recycle valve to close. The closed recycle valve will now direct the flow from the outlet of the compressor (i.e. compressed gas) into the well annulus from which it is injected into an adjacent formation. A check valve is positioned downstream of the compressor to prevent back flow into the outlet of the compressor during the start-up period.

BRIEF DESCRIPTION OF THE DRAWINGS

The actual construction, operation, and apparent advantages of the present invention will be better understood by referring to the drawings which are not necessarily to scale and in which like numerals refer to like parts and in which:

FIG. 3 is an enlarged, sectional view of the turbine bypass valve of the SPARC of FIG. 1 when the bypass valve is in a first or open position;

FIG. 3A is a cross-sectional view taken along line 3A—3A of FIG. 3;

FIG. 4 is a sectional view of the turbine bypass valve of FIG. 2 when the bypass valve is in a second or closed position;

While the invention will be described in connection with its preferred embodiments, it will be understood that this invention is not limited thereto. On the contrary, the invention is intended to cover all alternatives, modifications, and equivalents which may be included within the spirit and scope of the invention, as defined by the appended claims.

BEST KNOWN MODE FOR CARRYING OUT THE INVENTION

Figure 1:
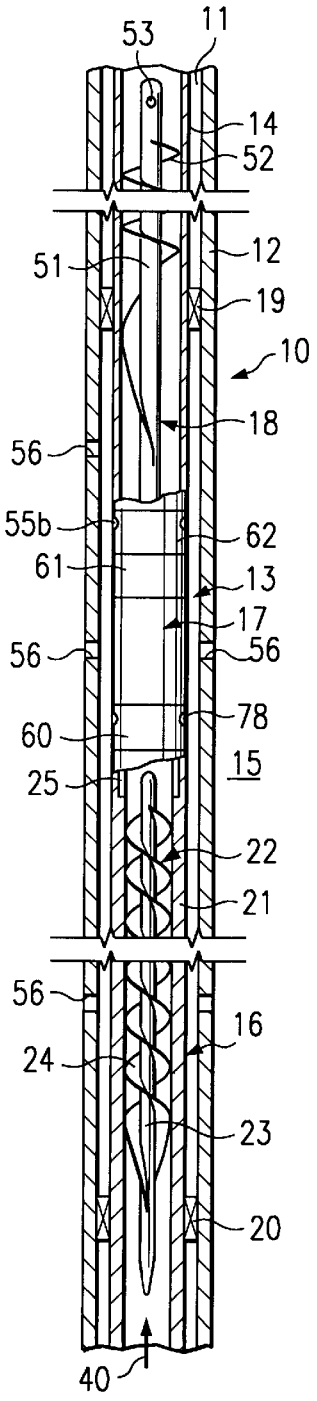
FIG. 1 is an elevation view, partly in section, of the complete subsurface separator-compressor (SPARC) system of the present invention when in an operable position within a production wellbore.

Referring more particularly to the drawings, FIG. 1 discloses a downhole section of production well 10 having a wellbore 11 which extends from the surface into and/or through a production zone (neither shown). As illustrated in FIG. 1, wellbore 11 is cased with a string of casing 12 which is perforated or otherwise completed (not shown) adjacent the production zone to allow flow of fluids from the production zone into the wellbore as will be fully understood by those skilled in the art. While well 10 is illustrated in FIG. 1 as one having a substantially vertical, cased wellbore, it should be recognized that the present invention can equally be used in open-hole and/or underreamed completions as well as in inclined and/or horizontal wellbores.

Still further, although the subsurface processing and reinjection compressor system (SPARC) 13 of the present invention has been illustrated as being assembled into a string of production tubing 14 and lowered therewith into the wellbore 11 to a position adjacent formation 15 (e.g. a gas cap above a production formation), it should be recognized the system 13 could be assembled as a unit and then lowered through the production tubing 14 by a wireline, coiled tubing string, etc. after the production tubing has been run into the wellbore 11.

As shown, SPARC 13 is basically comprised of three major components, a first or upstream auger separator section 16, turbine-compressor section 17, and a second or downstream auger separator section 18. Packers 19, 20 are spaced between system 13 and casing 12 for a purpose described below.

The first or upstream auger separator section 16 is comprised of an auger separator housing 21 which, in turn, is fluidly connected at its lower end into production tubing string 14 to receive the flow of the production stream as it flows upward through the tubing. An auger separator 22 is positioned within the housing 21 and is adapted to impart a spin on the production stream as it flows therethrough for a purpose to be described later. As shown, auger separator 22 is comprised of a central rod or support 23 having a helical-wound, auger-like flight 24 secured thereto. Auger flight 24 is adapted to impart a swirl to the production stream to separate heavy liquids and particulate material from the production stream as the stream flows upward through the auger separator 16. Upstream auger housing 21 has slots 25 or the like in the wall thereof for a purpose to be described below.

Auger separators of this type are known in the art and are disclosed and fully discussed in U.S. Pat. No. 5,431,228 which issued Jul. 11, 1995, and which is incorporated herein in its entirety by reference. Also, for a further discussion of the construction and operation of such separators, see "New Design for Compact-Liquid Gas Partial Separation: Down Hole and Surface Installations for Artificial Lift Applications", Jean S. Weingarten et al, SPE 30637, Presented Oct. 22–25, 1995 at Dallas, Tex.

Figure 2:
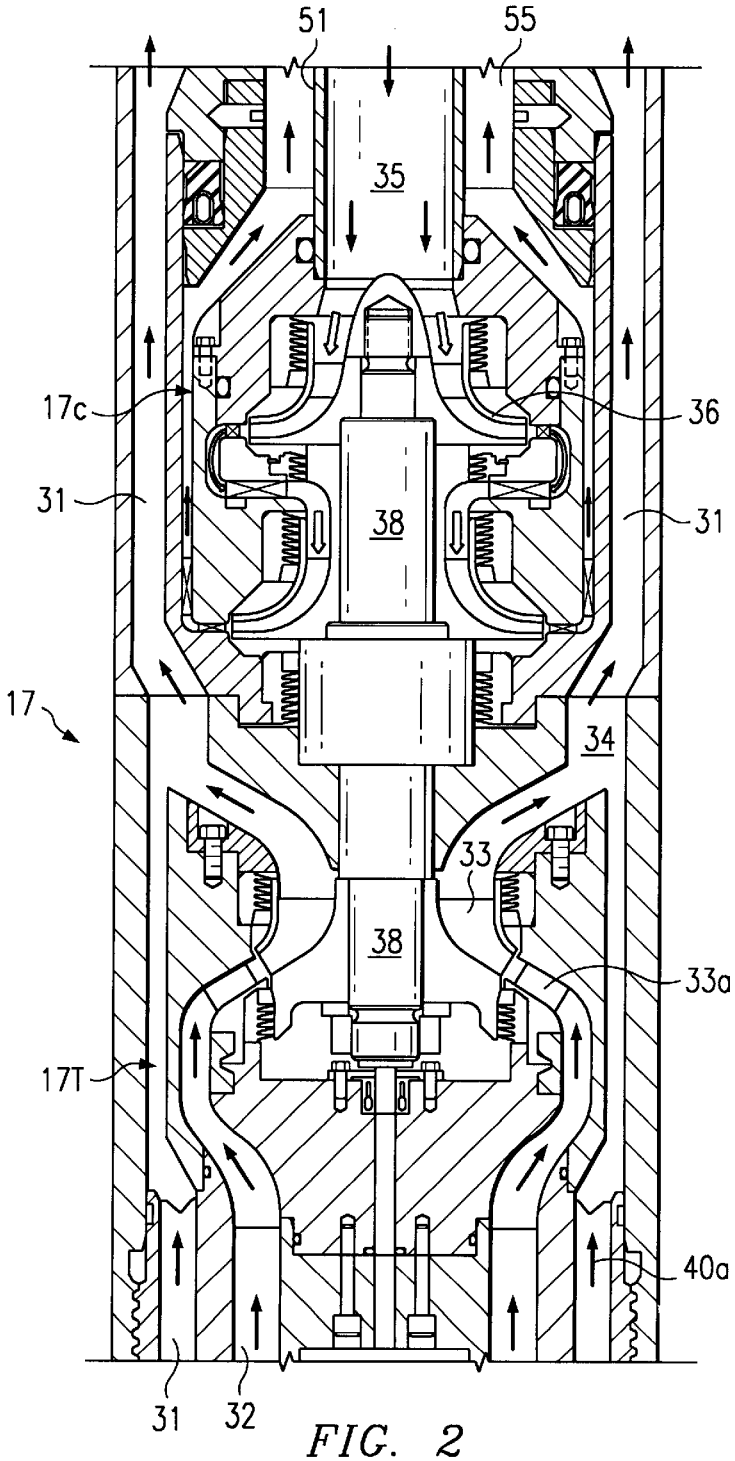
FIG. 2 is an enlarged, sectional view of the turbine-compressor section of the SPARC of FIG. 1.
Figure 5:
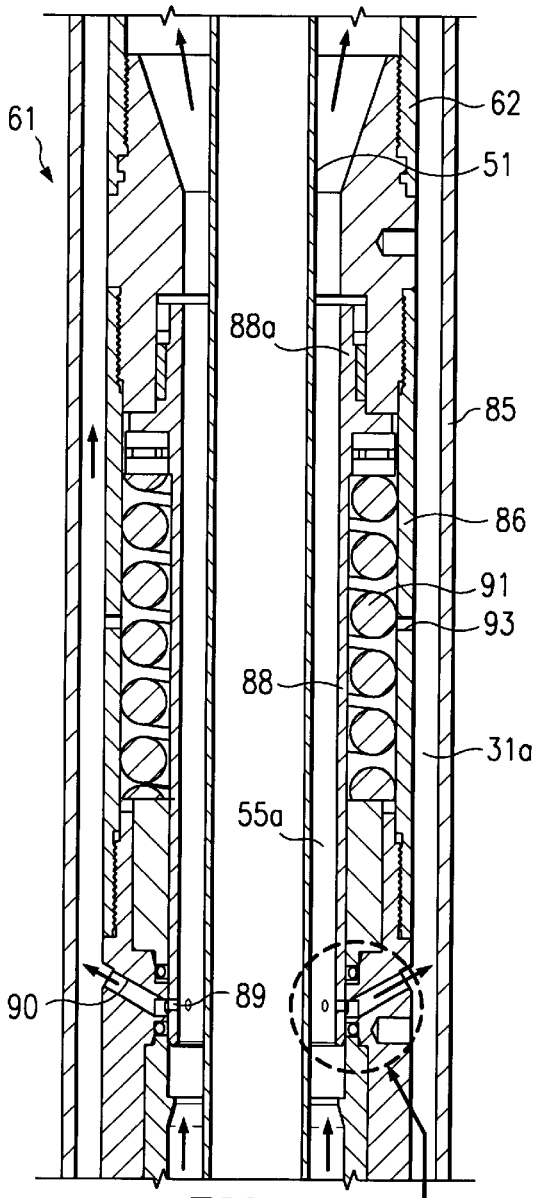
FIG. 5 is an enlarged, sectional view of the compressor recycle valve of the SPARC of FIG. 1 when the recycle valve is in a first or open position.

Referring now to FIG. 2, it can be seen that the slots 25 of FIG. 1 open into by-pass passages 31 which pass around the turbine-compressor section 17. Turbine-compressor section 17 may vary in construction, but as illustrated in FIG. 2 section 17 is comprised of a turbine 17T and a compressor 17C. Turbine 17T is comprised of an inlet(s) 32, rotary vanes 33 mounted on shaft 38, stationary vanes 33*a*, and an outlet 34. Compressor 17C is comprised of an gas inlet 35, rotary vanes 36 mounted on the other end of shaft 38, and a gas outlet(s) 55.

As will be understood, as a power fluid flows through turbine section 17T, it will rotate vanes 33 which are attached to shaft 38, which, in turn, will rotate vanes 36 in compressor section 17C to thereby compress gas as it flows therethrough. Bypass passageway 31 extends around turbine-compressor section 17 and allows solid particulate-laden fluids to by-pass turbine 17T thereby alleviating the erosive effects of such fluids and solids on the turbine vanes.

In a typical operation of a SPARC, a mixed gas-oil stream 40 from a subterranean, production zone (not shown) flows upward to the surface (not shown) through production tubing 14. As will be understood in the art, most mixed oil-gas streams will include some produced water so as used herein, "mixed oil-gas stream" is intended to include streams having some produced water therein. Also, it is not uncommon for most production streams to also include substantial amounts of solid particulate material (e.g. sand produced from the formation, rust and other debris, etc.).

As the mixed gas-oil stream flows upward through separator section 16, auger flights 24 of auger separator 22 will impart a spin or swirl on the stream wherein the heavier components of the stream (e.g. oil, water, and the solid particulates) in the stream are forced to the outside of the auger by centrifugal force while the remainder of the stream remains near the wall of center rod 23. As the stream flows toward the upper end of separator housing 21, the heavier components 40*a* (i.e. liquids and particulates) will exit through take-off slots 25 located near the top of auger 24 and will flow upward through bypass passages 31 thereby bypassing turbine vanes 33.

The remainder of gas-oil stream 40 continues to flow upward through first or upstream separator section 16 and enters inlet(s) 32 of the turbine 17C to rotate vanes 33, shaft 38, and vanes 36 in compressor 17C. This stream (i.e. gas-liquid) then flows through outlet(s) 34 of the turbine 17T where it is recombined with the particulate-laden stream 40*a* in the bypass passages 31.

The recombined stream, which is now essentially the original production stream, flows through the second or downstream separator section 18 (FIG. 1) which, in turn, is comprised of a central hollow, gas inlet tube 51 having an auger flight 52 thereon. As the combined stream flows upward through the second separator 18, it will again be spun to force the heavier components, i.e., liquids and particulate material, outwardly by centrifugal force while a portion of the gas 50 will separate and remain inside against the outer wall of central tube 51. As the gas 50 reaches the upper end of gas inlet tube 51, it flows into the tube through an inlet port(s) 53 at the upper end thereof or through the open upper end (now shown) thereof.

The gas then flows down through tube 51 into inlet 35 of compressor 17C where it is compressed before it exits through outlet(s) 55 of the compressor. The compressed gas then ultimately flows through gas outlets 55b into the space isolated between packers 19, 20 in the well annulus and is injected into formation 15 through openings 56 (e.g. perforations) in casing 12 (FIG. 1). The liquids and unseparated gas, along with the particulates, then flow upward into the production tubing 14 through which they are then produced to the surface. For a further description of a SPARC of this type and its operation, see commonly assigned and co-pending U.S. patent application, Ser. No. 10/025,444, filed Dec. 19, 2001 and which is incorporated herein, in its entirety, by reference.

While SPARCs of this general type appear to function well in separating and compressing gas downhole, the turbine-compressor unit 17 may experience problems during the start-up of production (either initially or after the well has been shut-in) due to surging of the production stream which, in turn, is caused by alternating slugs of liquid and gas in the stream. As will be understood, this surging, if left unchecked, can seriously affect the operational life of the turbine.

This surging tends to subside as the production rate increases and the stream becomes a more consistent mixture of the liquid and gas. Accordingly, it is desirable to bypass the turbine-compressor unit 17 during this start-up period so that surging in the production stream does not adversely affect the turbine.

In accordance with the present invention, SPARC 13 includes means for protecting the turbine-compressor unit 17 during start-up. Basically, SPARC 13 includes a turbine bypass valve unit 60, a compressor recycle valve unit 61, and a check-valve unit 62 (see FIGS. 1 and 11), each of which contribute to protecting the SPARC during start-up.

Referring now to FIGS. 3, 3A, and 4, turbine bypass valve unit 60 is comprised of a housing 65 which is adapted to be connected (i.e. threaded) into SPARC 13 between upstream auger separator 16 and turbine-compressor unit 17. Housing 65 carries element 65*a* at its lower end which, in turn, includes a first valve seat 65*a* and a port 65*b* therethrough which opens into bypass passage 31. A tube 66 is concentrically positioned within housing 65 with the bypass passages 31 being formed by the annulus therebetween; passages 31 being fluidly contiguous with the bypass passages 31 which extend around turbine-compressor unit 17 (FIG. 2).

A hollow mandrel 67 is positioned and held within tube 66 by spider-like centralizers 68 or the like. Piston 69 is slidably mounted within mandrel 67 and carries valve element 70 on the outer end thereof When valve means 60 is in an open position (FIG. 3), flow is blocked through passage 70*a* through valve element 70 by piston 69 which, in turn, is seated onto valve seat 71 in valve element 70. When valve means 60 is in a closed position (FIG. 4), piston 69 moves valve element 70 downward to open passage 70*a* while seating valve element 70 onto first valve seat 65*a* to thereby block flow through port 65*c*. This operation will be more fully explained below.

A collet 72 having a plurality of latch fingers 73 thereon is mounted in the upper end of hollow mandrel 67. Each finger 73 has a latch or lug 74 which is adapted to be received by either circumferential groove 75 (FIG. 3) or groove 76 (FIG. 4), both of which are formed around and spaced along the upper end of piston 69. The cooperation between the lugs 74 and the respective grooves serves to latch valve element 70 in its respective open or closed position. Compression spring 77 is positioned between piston 69 and the inner lower portion of mandrel 67 to normally bias piston 69 upwardly to an open position as viewed in FIG. 3.

In operation, SPARC 13 is positioned within production tubing 14 with turbine bypass valve 60 in its open position (FIG. 3). Spring 77 biases piston 69 upwardly so that valve 70 is seated on the tapered lower end 71 of piston 69 whereby port 65*b* is open to flow while passage 70*a* is closed. Lugs 74 of collet 72 engage groove 75 on piston 69 to aid in holding the valve in its open position. Further, the pressure of the production stream 40, which is also effectively the "wellhead" pressure (i.e. pressure when the choke 80 is closed or only partly open, FIG. 11), is inherently being applied against the underside of valve 70 due to the reverse flow through turbine inlet passage 32 and ports 67*a* in mandrel 67. During start-up, the combination of this pressure on the underside of piston 69, the bias of spring 77, and the holding power of the collet 72, is greater than the pressure of gas cap 15 which is being applied to the top of piston 69 through both the openings 78 in housing 65 and the passage 79 in mandrel 67, thereby keeping the valve in its open position.

As the well 10 is put onto production by gradually opening choke valve 80 at the surface (FIG. 11), production stream 40 will flow upward through upstream auger section 16. The heavier components (e.g. particulates) will separate and will flow upward through passages 31*a*. The remainder of the flow 40 will flow through port 65*b* and into bypass passages 31*a* and will be recombined with the separated flow from auger section 16 whereby the entire production stream will bypass turbine 17T for so long as valve 60 remains in its open position. The well will be operated with choke 80 only partly open (e.g. ⅓open) for sufficient time to allow any liquid slugs to be purged from the well.

After purging the liquid slugs from the well, choke 80 is then smoothly opened to its full open position. As choke 80 is opened, the flow rate of production stream 40 will increase which, in turn, decreases the wellhead pressure. As the wellhead pressure (i.e. turbine inlet pressure) decreases, the difference in pressure between the turbine inlet 32 and gas cap 15 will increase. This differential pressure will be sufficient to release collet pawls 74 from groove 75 and force piston 69 downward against the bias of spring 77 to move valve element 70 onto seat 65*a* to thereby close port 65*b* and open passage 70*a*. Piston 69 will be held downward against the bias of spring 77 by the differential pressure and the collet lugs 74 which now engage groove 76.

With valve 60 closed (FIG. 3), only the separated components from auger section 16 will flow through bypass passages 31*a* with the remainder of stream 40 flowing through opening 70*a* in valve element 70 and into turbine inlet supply passages 32 to drive turbine 17T. The turbine 17T and compressor 17C will begin to rotate and will accelerate up to the well operating conditions. Turbine bypass valve 60 will remain closed until the well is shut in by closing choke valve 80 during which time the turbine inlet pressure will approach the gas cap pressure. The bias of spring 77 plus the increased pressure differential will now reset the turbine bypass valve 60 back to its open position to again allow any flow to bypass turbine 17T.

To prevent compressor 17C from surging during startup and shutdown sequences, compressor recycle valve 61 is positioned within SPARC 13 above turbine-compressor unit 17. Referring now to FIGS. 5–8, compressor recycle valve 61 is comprised of outer housing 85, which is adapted to be connected (i.e. threaded) into SPARC 13 between turbine-compressor unit 17 and check valve unit 62. An inner housing 86 is concentrically-positioned within outer housing 85 and forms a first passage 31*a* therebetween which is fluidly connected to bypass passage 31, and hence to turbine outlet 34, to receive the combined flow therefrom (see FIG. 2).

Figure 7:
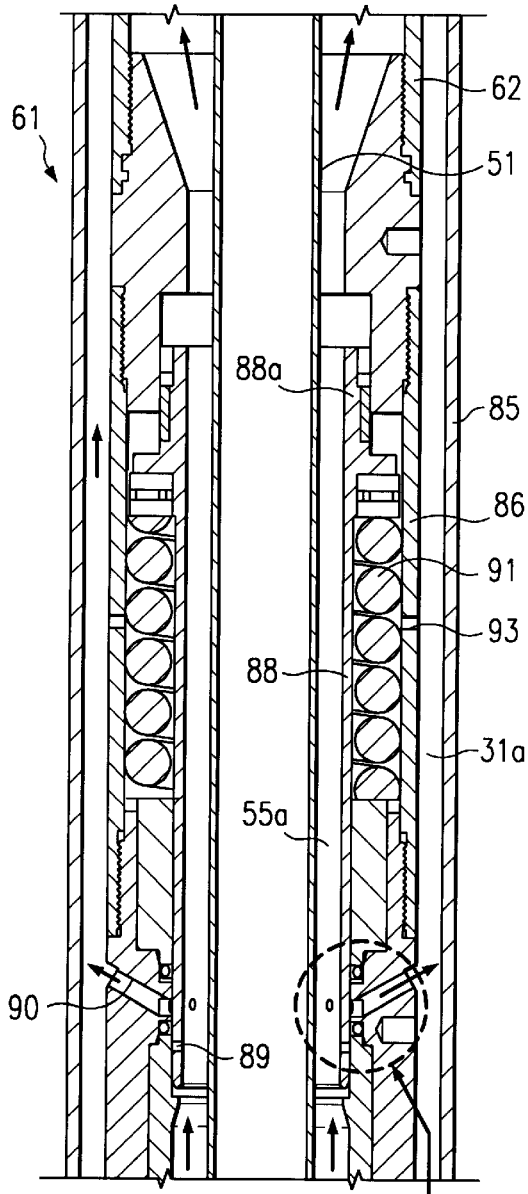
FIG. 7 is an enlarged, sectional view of the compressor recycle valve of FIG. 5 when the recycle valve is in a second or closed position.
Figure 6:
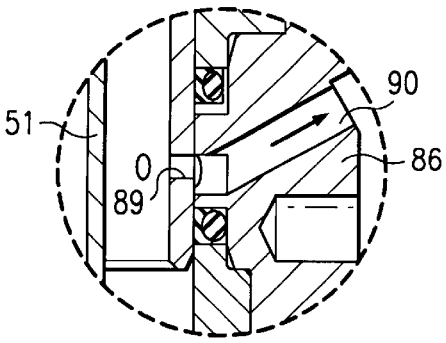
FIG. 6 is a further enlarged, sectional view taken within the circular line 6—6 of FIG. 4.
Figure 8:
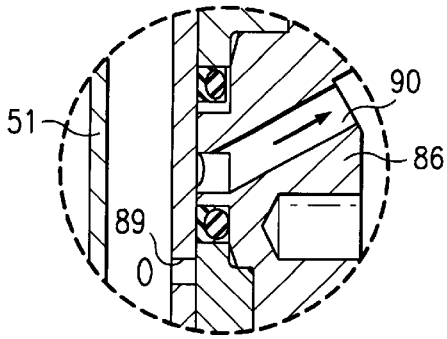
FIG. 8 is a further enlarged, sectional view taken within the circular line 8—8 of FIG. 7.

A hollow, cylindrical piston 88 is slidably positioned within inner housing 86 and is movable between an open position (FIGS. 5 and 6) and a closed position (FIGS. 7 and 8). Piston 88 is positioned around gas inlet tube 51 and the two form a second passage 55*a* therebetween which, in turn, is fluidly connected to the compressor outlet 55.

Piston 88 has one or more ports 89 located near the lower end thereof which (a) are aligned with passages 90 in inner housing 86 to allow flow from compressor outlet 55 into turbine outlet annulus 31*a* when valve 61 is in the open position and (b) are misaligned with passage 90 to block flow from compressor outlet 55 into annulus 31 when in the closed position. Compression spring 91 normally biases piston 88 upward (as viewed in FIGS. 5–8) to its open position where flow from the compressor outlet 55 will flow into bypass passage 31*a* so that the gas from gas inlet tube 51 will be recycled back through downstream separator 18. Piston 88 has a port 93 therein which allows the pressure from the turbine outlet 31*a* to be applied to the underside of the upper end 88*a* of piston 88 while the pressure from the compressor outlet 55*a* is applied to the upperside thereof Valve 61 is initially open when well 10 is shut in and closes as choke valve 80 (FIG. 11) is opened at the surface during SPARC startup. Opening of choke valve 80 causes an increase in the pressure differential between the compressor outlet 55*a* and the turbine outlet pressure 31*a* which, in turn, causes piston 88 to move downward against the bias of spring 91 to close recycle valve 61. Flow from the compressor outlet 55 will now flow through passage 55*a* and into check valve assembly 62 which, in turn, will open when a desired pressure is reached to allow the compressed gas to flow through ports 55*b* (FIGS. 1 and 10 and then be injected into formation 15. Valve 61 remains closed as long as SPARC 13 is on line and injecting gas into gas cap 15. The bias of spring 91 will return piston to its original position to reopen recycle valve 61 as choke 80 is closed to shut in the well.

Figure 9:
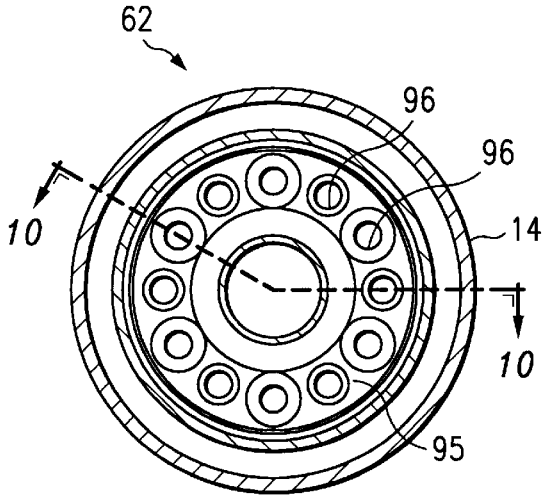
FIG. 9 is a cross-sectional view of the check valve assembly of the SPARC of FIG. 1.
Figure 10:
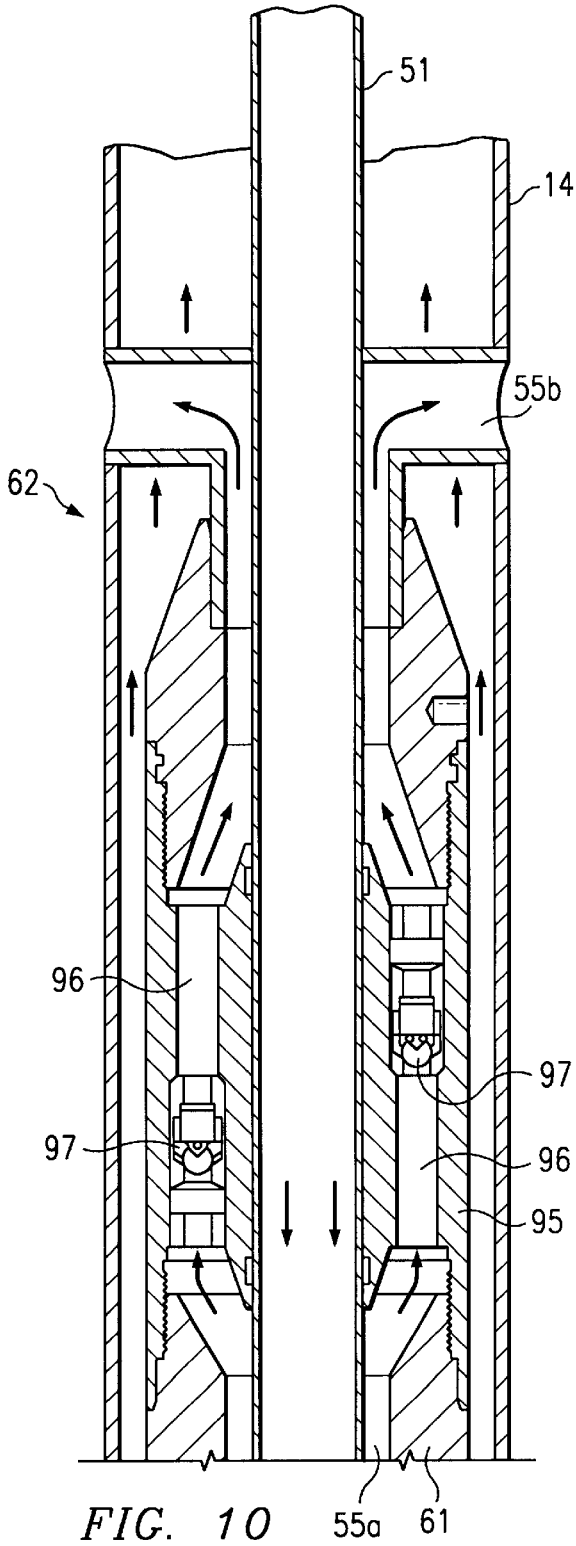
FIG. 10 is an enlarged, sectional view of the check valve assembly taken along line 10—10 of FIG. 9.

Check valve assembly 63 is provided primarily to prevent backflow through the SPARC during startup. Referring more particularly to FIGS. 9 and 10, check valve assembly 62 is comprised of a housing 95 which is connected to the upper end of compressor recycle valve 61. Housing 95 has at least one passage 96 therethrough (twelve shown), each of which has a check valve 97 mounted therein. The check valves are all in a closed position (FIG. 10) when the well is shut in to initially block back flow from the compressor outlet 55 through passages 96 but are set to open when the pressure of the compressor output 55 exceeds the pressure of the gas cap 15. Once the check valves open, the compressed gas from the compressor 17 can now flow through passages 96 and exit through outlets 55*b* into the well annulus between packers 19, 20 from which it is then forced into gas cap 15.

Figure 11:
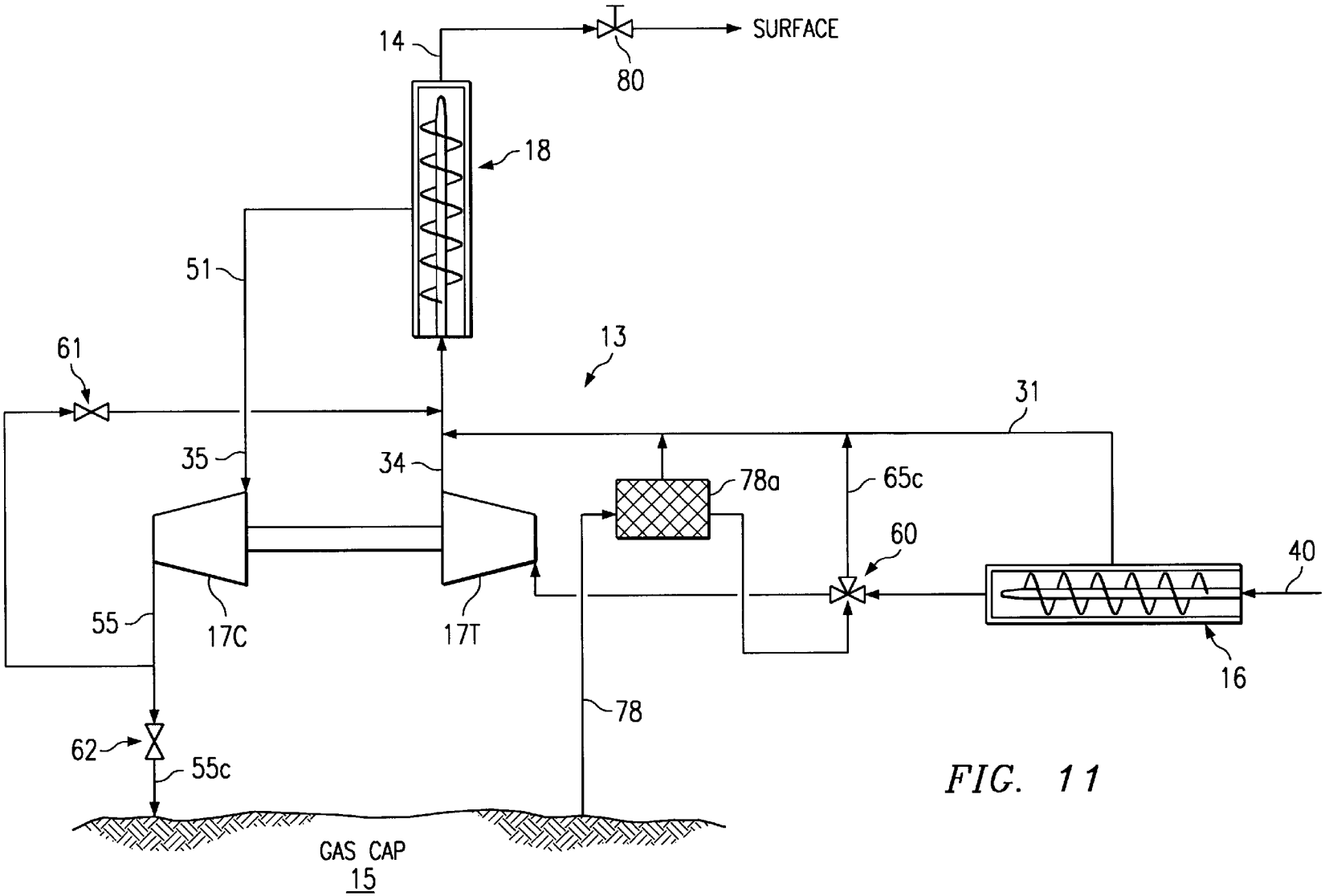
FIG. 11 is a schematic flow diagram of a well being produced through the SPARC of FIG. 1.

Referring now to the flow diagram in FIG. 11, when the well is shut in, choke valve 80 is closed and there is no flow through the well, hence there is no flow through SPARC 13. While the well is shut in, turbine bypass valve 60 and compressor recycle valve are open as explained above. Choke valve 80 is gradually opened to put the well on production whereby the production stream 14 begins to flow to the surface through SPARC 13 and production string 14.

As stream 40 passes through upstream separator 16, some heavier components (e.g. solids, etc.) are separated and removed through bypass passage 31. The remainder of the stream 40 flows into the open turbine bypass valve 60 and exits through outlet port 65*c* to be recombined with the separated flow in line 31. Thus, the entire production stream 40 bypasses turbine 71T for so long as the bypass valve 60 is open and thereby prevents surging within the turbine during the initial stages of the start-up of the well. The pressure in gas cap 15, which is used in the operation of bypass valve 60, is transmitted to valve 60 through line 78 and filter 78*a*.

As choke valve 80 is opened further, turbine bypass valve 60 closes so that the remainder of stream 40 now flows into turbine 17T through line 32. As stream 40 begins to power the turbine 17T, compressor 17C also begins to rotate. To prevent the compressor 17C from operating in surge conditions during the well start up, the output of the compressor is initially passed through the open, recycle valve 61 and is combined with the separated components in line 31 and any turbine output in line 34. As choke valve 80 is opened further and the production rate is increased, recycle valve 61 will close thereby directing all of the compressor output (i.e. compressed gas) through check valve assembly 62 and into gas cap 15 through outlets 55*c*.

When the well is shut down, the above described procedure is reversed. That is, as choke valve 80 is closed and production is ceased, compressor recycle valve 61 opens and turbine bypass valve opens to prevent the turbine and compressor from operating under surge conditions as the well is being shut down.

What is claimed is:

1. A separator-compressor system (SPARC) adapted to be positioned downhole in a production wellbore wherein an annulus is formed between said SPARC and said wellbore, said SPARC adapted to separate and compress at least a portion of the gas from a mixed gas-oil production stream comprised of liquid, gas, and particulates as said stream flows upward through said wellbore; said separator-compressor system comprising:

an upstream separator section for separating at least a portion of said production stream from the remainder of said stream;

a turbine-compressor section positioned downstream from said upstream separator section; said turbine-compressor comprising:

a turbine having an inlet and an outlet and adapted to be driven by said remainder of said stream; and a compressor having an inlet and an outlet and adapted to be driven by said turbine; and means for preventing surging in said turbine during start-up of said SPARC; and a downstream separator section positioned downstream from said turbine-compressor section.

2. The SPARC of claim 1 wherein said means for preventing surging of said turbine comprises:

at least one by-pass passage passing around said turbine and said compressor; and a turbine bypass valve for directing both said separated portion of said stream and said remainder of said stream into said by-pass passage when said turbine bypass valve is in a open position and for directing said separated portion of said stream through said by-pass passage and said remainder of said stream through said turbine when said turbine bypass valve is in a closed position.

3. The SPARC of claim 2 including:

means for preventing surging in said compressor during start-up of said SPARC.

4. The SPARC of claim 3 wherein said means for preventing surging in said compressor comprises:

a compressor recycle valve means for directing flow from said outlet of said compressor into said by-pass passage when said recycle valve is in an open position and for directing said flow from said outlet of said compressor into said annulus formed between said SPARC and said production wellbore when said compressor recycle valve is in a closed position.

5. The SPARC of claim 4 including:

means positioned upstream from said compressor for preventing back flow through said outlet of said compressor.

6. The SPARC of claim 5 wherein said means for preventing back flow through said outlet of said compressor comprises:

a check valve set to open when the pressure of the flow from said outlet of said compressor exceeds a set value.

7. The SPARC of claim 4 wherein said downstream separator section comprises:

a downstream separator housing positioned above said turbine-compressor section;

a central hollow support tube positioned within said downstream separator housing, said hollow tube being fluidly connected to said inlet of said compressor at its lower end and having an gas inlet opening at its upper end; and an auger flight affixed to said central hollow tube and extending along a substantial portion of the length thereof to impart a spin on said oil-gas stream to separate at least a portion of said gas from the remainder of said stream whereby said separated portion of said gas flows through said gas inlet opening and into said inlet of said compressor.

8. The SPARC of claim 7 wherein said turbine bypass valve comprises:

a housing connected between said upstream separator section and said turbine-compressor section, said housing having a bypass passage and a turbine inlet supply passage therethrough;

a valve seat at one end of said housing;

a piston slidably mounted within said housing and moveable between a first position and a second position;

a valve element carried by said piston and adapted to direct flow through said bypass passage in said housing when said piston is in said first position and said turbine bypass valve is in an open position and adapted to direct flow through said turbine inlet supply passage when said piston is in said second position and said turbine bypass valve is in a closed position; and means for moving said piston between said first and second positions to thereby open and close said turbine bypass valve.

9. The SPARC of claim 8 wherein said turbine bypass valve includes:

a spring normally biasing said piston towards said first position.

10. The SPARC of claim 9 wherein said turbine bypass valve includes:

a latch for releasably latching said piston in said first and second positions, respectively.

11. The SPARC of claim 10 wherein said latch comprises:

a collet having a plurality of latch fingers; and a lug on each of said plurality of latch fingers, each of said lugs adapted to cooperate with first and second circumferential grooves on said piston to releasably latch said piston in said first and second positions, respectively.

12. The SPARC of claim 11 wherein said means for moving said piston includes the application of differential pressure across said piston wherein said differential pressure is the difference between the outlet pressure of said turbine and the pressure within said annulus.

13. The SPARC of claim 4 wherein said compressor recycle valve comprises:

a housing connected downstream of said turbine-compressor section, said housing having a first passage fluidly connected to the outlet of said turbine and a second passage fluidly connected to said outlet of said compressor;

a piston slidably mounted within said housing and movable between a first and a second position;

a valve element carried by said piston and adapted to direct flow from said outlet of said compressor through said first passage when said piston is open in said first position and adapted to direct flow from said outlet of said compressor through said second passage when said piston is closed in said second position; and means for moving said piston between said first and second positions to thereby open and close said turbine bypass valve.

14. The SPARC of claim 13 wherein said compressor recycle valve includes:

a spring normally biasing said piston open towards said first position.

15. The SPARC of claim 14 wherein said means for moving said piston includes application of differential pressure across said piston wherein said differential pressure is the difference between the outlet pressure of said compressor and the outlet pressure of said turbine.

16. A method for separating and compressing at least a portion of the gas in a mixed gas-oil production stream which is comprised of liquid, gas, and heavier components as said stream flows upward through a wellbore, said method comprising:

positioning a separator-compressor system (SPARC) downhole within said wellbore whereby an annulus is formed between said SPARC and said wellbore;

said SPARC having an upstream separator section, a turbine-compressor section, and a downstream separator section;

opening said wellbore at the surface to allow flow of said production stream into said upstream separator section of said SPARC;

bypassing all of said production stream from said upstream separator section around said turbine-compressor section until surging in said production stream has subsided;

increasing the flow rate of said production stream through said wellbore;

separating at least a portion of the heavier components of said production stream as said stream flows through said upstream separator section;

separating the separated portion of the heavier components around said turbine-compressor section and directly the remainder of said production stream through said turbine-compressor section to drive the turbine therein;

recombining said separated portion of the production with the remainder of the stream after the remainder of the stream as passed through said turbine;

passing the combined stream through said downstream separator section to separate at least a portion of the gas in said stream from the remainder of the stream;

flowing said separated gas to a compressor in said turbine-compressor section to thereby compress said gas; and flowing the compressed gas from said compressor into said annulus.

17. The method of claim 16 including:

directing the flow from the outlet of said compressor into said downstream separator section until surging in said production stream has subsided and then directing said flow from said compressor into said annulus.

18. The method of claim 17 including:

blocking back flow into the outlet of said compressor.

19. A separator-compressor system (SPARC) adapted to be positioned downhole in a production wellbore wherein an annulus is formed between said SPARC and said wellbore, said SPARC adapted to separate and compress at least a portion of the gas from a mixed gas-oil production stream comprised of liquid, gas, and particulates as said stream flows upward through said wellbore; said separator-compressor system comprising:

an upstream separator section for separating at least a portion of said production stream from the remainder of said stream;

a turbine-compressor section positioned downstream from said upstream separator section; said turbine-compressor comprising:

a turbine having an inlet and an outlet and adapted to be driven by said remainder of said stream; and a compressor having an inlet and an outlet and adapted to be driven by said turbine; and means for preventing surging in said turbine during start-up of said SPARC, said means comprising at least one by-pass passage passing around said turbine and said compressor; and a turbine bypass valve for directing both said separated portion of said stream and said remainder of said stream into said by-pass passage when said turbine bypass valve is in a open position and for directing said separated portion of said stream through said by-pass passage and said remainder of said stream through said turbine when said turbine bypass valve is in a closed position; and a downstream separator section positioned downstream from said turbine-compressor section.

* * * * *